United States Patent [19]

Kelly

[11] 4,071,167

[45] Jan. 31, 1978

[54] APPARATUS FOR DISPERSING AGGLOMERATES

[76] Inventor: Brian M. Kelly, 1007 Berkshire Road, Grosse Pointe Park, Mich. 48230

[21] Appl. No.: 728,266

[22] Filed: Sept. 30, 1976

[51] Int. Cl.[2] ..... B02C 7/08; B02C 7/14

[52] U.S. Cl. ..... 366/172; 241/258; 241/259; 222/25; 366/306

[58] Field of Search ... 241/245, 258, 259, 259.1–259.3; 222/237, 25; 259/DIG. 30, 7, 8

[56] References Cited

U.S. PATENT DOCUMENTS

| | | | |
|---|---|---|---|
| 753,129 | 2/1904 | Faust | 241/259 |
| 1,405,878 | 2/1922 | Torrance | 241/259 X |
| 1,725,743 | 8/1929 | Anderson | 241/245 X |
| 1,987,944 | 1/1935 | Rafton | 241/258 X |
| 2,599,543 | 6/1952 | Coghill et al. | 241/259 X |
| 2,909,332 | 10/1959 | Brown et al. | 241/245 X |

*Primary Examiner*—Robert B. Reeves
*Assistant Examiner*—Francis J. Bartuska
*Attorney, Agent, or Firm*—William T. Sevald

[57] ABSTRACT

An apparatus for dispersing substances into one another by subjecting them to shear forces between a rotating platen and a stationary or counter-rotating platen which have opposed work surfaces interfaced and forced toward engagement with one another. An oriface leads through one platen to the other platen. A pump forces an agglomerate of substances through the channel and radially outwardly between the platens during relative rotation of the platens. The agglomerate is subjected to shear forces as it moves radially outwardly between the platens to disperse the substances to one another. The mutually dispersed substances emit at the periphery of the platens and are collected in a trough. The pressure developed by the pump and the force directing the platens toward engagement with one another are opposed and coordinated to control the thickness of the agglomerate between the platens in conjunction with control of the speed of relative rotation between the platens — to achieve desired shear forces in agglomerates of various types.

2 Claims, 2 Drawing Figures

APPARATUS FOR DISPERSING AGGLOMERATES

BACKGROUND OF THE INVENTION

In various agglomerates, such as paint, enamel, ink, synthetic resins, natural resins, pastes, etc., two or more substances constitute the mass. In manufacturing mixtures, while the substances may be churned in one container, it has been found that various portions of one or more of the substances maintains its separate identity in spite of being in apparent mixture. Pigment, such as carbon black, for example, when introduced into other substances resists integrating contact, such as with paint.

The vehicles, pigments and other things, such as dry lubricants like stearate of lead, maintain attachment among themselves and have boundary layers and surface tensions which resist connecting contact with other substances. Thus various degrees of mixture are encountered in the case of particle-to-particle interconnection which resists complete mutual dispersion. For example, to make gray paint, carbon black is introduced. If the carbon black is not thoroughly dispersed in the paint, the gray paint will be one shade in the can and an entirely different shade when applied with a brush, roller or gun because the application produces friction and shear which drives the pigment particles from attachment among themselves and forces them into dispersion with the paint by breaking down the boundary layers and surface tensions of both the pigment and the paint particles.

Various types of equipment have been used in the prior art to disperse the substances of conglomerates into one another in fine grain connecting contact such as drums rotating on a horizontal axis and having steel balls inside to tumble through the mass to effect dispersion. Also sand barrels on a vertical axis have been employed where the substances are forced through the sand while agitators rotate in the sand and agglomerate to drive the substances into contact with one another. Both such devices are slow, difficult and expensive to operate, and exceedingly difficult to clean and maintain.

SUMMARY OF THE PRESENT INVENTION

The present invention subjects a layer of the agglomerate to shear forces so that substances in the agglomerate are cut into themselves and cut into one another to divide each substance into its individual particles to penetrate the boundary layer and surface tension of each particle of each substance, and thus to distribute the particles of each substance throughout the particles of all the other substances. This disperses the substances thoroughly into one another.

A first platen and a second platen are superposed relative to one another with their work surfaces facing each other. One platen has a central oriface opening through its work surface. A pump forces the pre-mixed agglomerate through a pipe to the oriface and the agglomerate emits between the platens and moves radially outwardly between the platens. Force feed means urge the platens toward one another. One or both platens may be resiliently mounted to insure face-to-face universal alignment between their work surfaces. The pressure of the pump delivery of the agglomerate and the force exerted by the feed means are opposed and balanced against one another to control the thickness of the agglomerate between the platens and the intensity of the impingement of the work surfaces on the layer of the agglomerate between the platens. The platens are rotated relative to one another and the agglomerate is sheared and/or cut across continually under force and pressure as it moves from the central oriface to the outer edge of the platens where it emits and is collected in a trough.

The volumetric delivery of the pump, the viscosity of the substances, the type and characteristics of pigments, lubricants, etc., the pump pressure behind the delivery of the agglomerate, the force exerted by the feed means, the spacing between the platens, and the relative rotational speed between the platens are all coordinated to produce an intense shearing action in the agglomerate as it travels between the platens to thoroughly disperse all the particles of all the substances into one another.

The invention herein described in simplest form disperses solid particles in a liquid media, an example being dispersing pigment particles in a paint or ink natural or synthetic resin solution.

The pigment is pre-mixed with the resin solution until uniformity is reached. The pre-mix is then pumped by means of a high pressure gear pump to the inlet oriface in the center of the stator.

The rotor is depressed with sufficient force to the stator riding on the thin film of pre-mix flowing from the center of the stator. The variable speed drive of the rotor is engaged and the speed is increased to the desired RPM.

Force is applied downward on the rotor to develop the desired pressure as registered on a gauge at the discharge side of the gear pump.

The speed of the gear pump is then increased to produce the maximum volume of flow while maintaining the desired degree of dispersion.

The dispersion of the particles is accomplished by the tremendous shear generated in the liquids and solids as they flow spirally between the stator and the rotor. The shear increases from zero at the center to a maximum at the periphery of the rotor. As an example, a 36 inch rotor turning at 4000 RPM is traveling at 628 ft/sec. at the periphery.

This mill disperses continuously rather than batchwise. It will accomodate any viscosity that can be pumped, high or low. It can handle any pressures within the design limitations of the pumps. There is only one moving part, the rotor. The mill does not discolor the pigment in the dispersion process nor does it fracture pigment crystals as do other dispersion mills. The working surface of the rotor and stator can be made of any hard abrasion resistant material including steel, glass, tungsten carbide, etc., and can be made removable for inexpensive resurfacing in the event of wear, and for easy cleaning of the stator and rotor.

The structure and operation of the invention will be apparent from the foregoing and the following detailed description taken in connection with the accompanying drawings.

DETAILED DESCRIPTION OF THE ILLUSTRATED EMBODIMENTS

Figure 1:
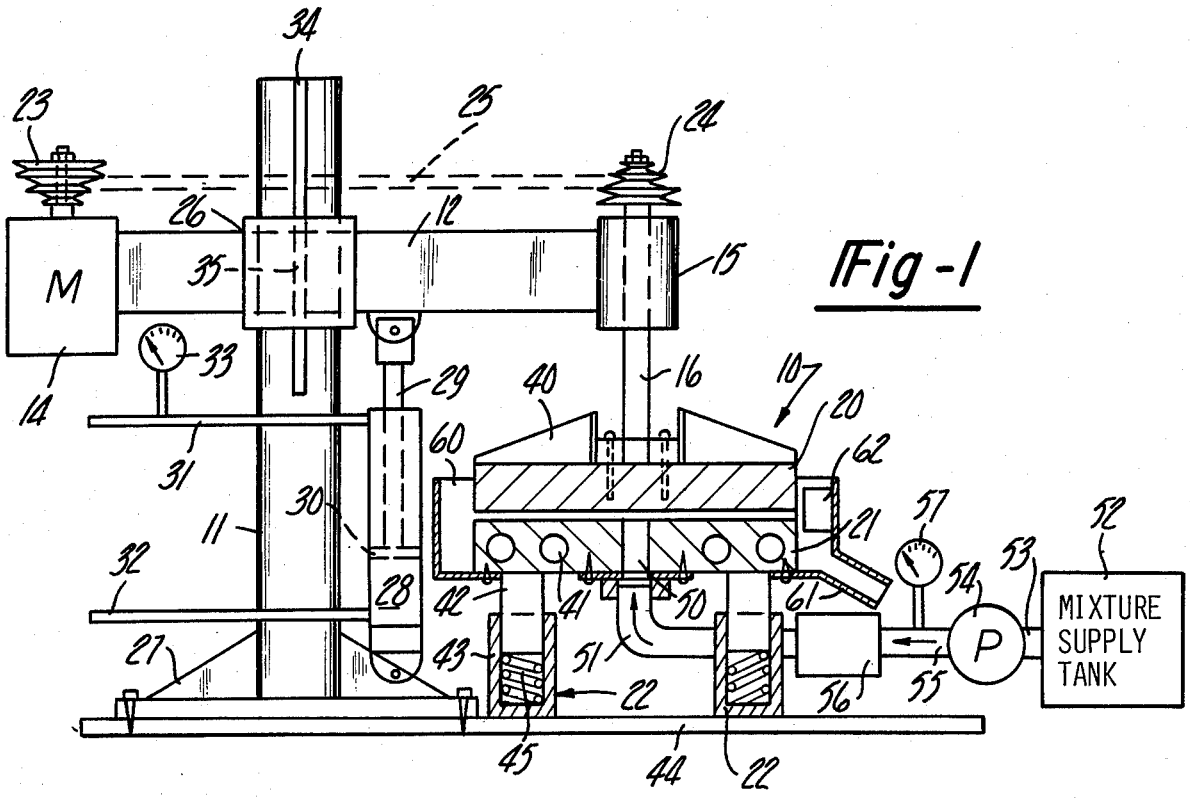
FIG. 1 is a side elevational view of the apparatus seen in FIG. 2. partly in cross-section, showing the internal construction of the stator, rotor, and spring support legs; and showing the drive belt in broken lines.
Figure 2:
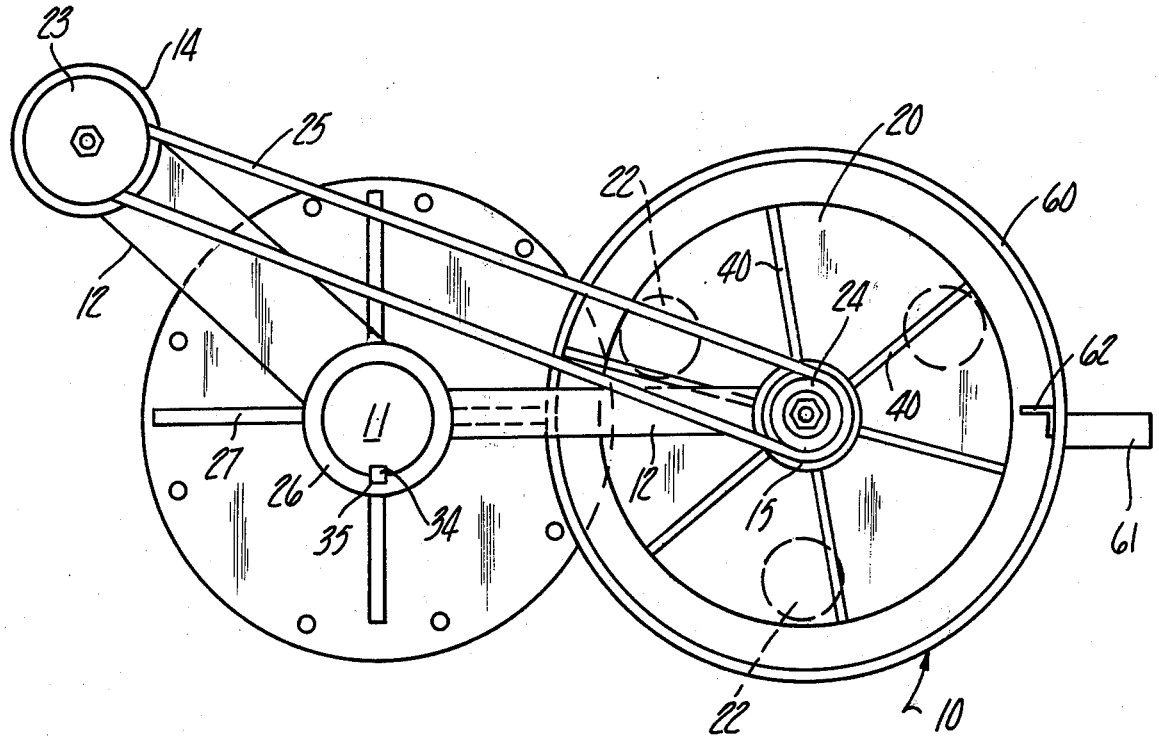
FIG. 2. is a slightly enlarged top elevational view of the apparatus seen in FIG. 1. with the pipes, pump, cylinder, floor, gauges and tank deleted.

Referring now to the drawings wherein like parts are designated by like reference numerals, the dispersion mill shown therein to illustrate the invention comprises a mill 10, a pedestal 11, a cross-arm 12 on the pedestal 11, a motor 14 and a quill 15 on either end of the cross-arm 12, a drive shaft 16 bearinged in the quill 15, a rotor platen 20 connected to the drive shaft 16, a stator platen 21 below the rotor platen 20, and supporting legs 22 under the stator platen 21.

Variable drive pulleys 23 and 24 are mounted on the motor 14 and drive shaft 16 respectively. A belt 25 interconnects the pulleys 23 and 24. A collar 26 surrounds the pedestal 11 and supports the cross-arm 12. The pedestal has a base 27. A hydraulic cylinder 28 is mounted on the base 27. A piston rod 29 of the cylinder 28 is connected to the cross-arm 12. A piston 30 lies in the cylinder 28 and is connected to the piston rod 29. A hydraulic pressure top feed line 31 enters the cylinder 28 at one side of the piston 30 at the top and a hydraulic bottom feed line 32 enters the cylinder 28 on the other side of the piston 30 at the bottom. A pressure gauge 33 is mounted on the top feed line 31. A key 34 on the pedestal 11 rides in a key way 35 in the collar 26 holding the cross-arm 12 at the proper angle to locate the rotor platen 20 directly over the stator platen 21.

A plurality of air fanning fins 40 on the rotor platen 20 dissipate heat from the rotor platen 20 generated by the frictional engagement between the platens 20, 21 when relatively rotated. A plurality of coolant channels 41 are formed in the stator platen 21. Coolant circulated through the channels 41 absorbs the heat from the stator platen 21 generated by the frictional engagement and relative rotation between the platens 20, 21. Cold water is a suitable coolant.

The legs 22 include a post 42 mounted on the stator platen 21, a socket 43 resting on the base or floor 44 and a spring 45 lying between the post 42 and the socket 43. The legs 22 thus resiliently support the stator platen 21 to allow it to conform to the dynamic plane of the rotor stator 20 so that there is complete contact at their interface.

The stator platen 21 has a central axial aperture 50. A supply pipe 51 leads to the aperture 50. An agglomerate mixture supply tank 52 lies adjacent the mill 10. A pipe 53 leads through a pump 54 to a pipe 55. A flexible coupling 56 interconnects the pipes 55 and 51 and allows the stator platen 21 to move on the spring legs 22 without strain on the pipes. A pressure gauge 57 is connected to the supply pipes down-stream from the pump 54, such as in the pipe 55. The pump 54 draws pre-mixture agglomerate from the tank 52 and forces it through the pipes 55, 51 to the aperture 50 from which it emits at the interface of the platens 20 and 21 and flows radially outwardly therebetween. When the platens are under relative rotation, the radial flow of the agglomerate takes a spiral path. The agglomerate emits from the outer peripheral edges of the platens 20, 21 at their interface. A circular trough 60 is mounted on the stator platen 21 and surrounds both platens 20, 21. A spout 61 on the trough 60 channels the milled agglomerate from the trough 60 into containers, not shown. A doctor blade 62 on the trough 60 at the spout 61 removes any adhering milled agglomerate from the edges of the platens 20, 21.

In operation, the pre-mixed agglomerate lies in the tank 52. The motor 14 is running to rotate the rotor platen 20 with the platens 20, 21 spaced slightly apart. The pump 54 is then started and it draws the agglomerate from the tank 52 and feeds it through the oriface 50 in the stator platen 21 where it flows radially outwardly between the slightly spaced platens. Thereupon hydraulic pressure is fed to the cylinder 28 to force the cross-arm downwardly bringing the rotor platen 20 into frictional engagement with the agglomerate between the platens until it is reduced to a thin layer with the platens 20, 21 all but in direct contact. The pump 54 is then accelerated to provide forced increased flow of the agglomerate between the platens 20, 21. This creates a pressure between the platens 20, 21 causing the posts 42 to depress the springs 45 in the sockets 43 allowing the stator platen 21 to move away from the rotor platen 20. Thereupon more pressure is fed to the cylinder 28 via the pipe 31 to bring the rotor platen 20 closer to the stator platen 21 to maintain frictional shearing action between the platens 20, 21 on the agglomerate. The pressure of the hydraulic line 31 is read on the gauge 33 and the pressure of the feed of the agglomerate is read on the gauge 57 on the feed line 55. By examining the milled agglomerate emitting at the peripheral edge of the platens 20, 21 for desired dispersion of ingredients, by watching the flow of the milled agglomerate for desired volume, by reading the gauges 33, 57 and adjusting the hydraulic pressure and the feed pressure, the operator can adjust the mill to adopt it to the different demands of various viscosities, pigments, lubricants and solids of the agglomerate to produce the desired degree of dispersion of the ingredients into one another.

While a variable speed belt drive is shown, it is considered within the scope of the invention and the claims to connect a variable speed motor directly to the drive shaft on the rotor platen. A screw jack or weights may be used instead of the hydraulic cylinder and other substitutions and modifications made within the scope of the invention and the appended claims.

I claim:

1. A mill for dispersing the components of a substance into one another comprising, a stator platen, a rotor platen, said rotor platen being superposed on said stator platen in opposed relationship, means rotatably supporting said rotor platen, a drive connected to said rotor platen for rotating it relative to said stator platen to develop shear forces between said platens, said stator platen having an outer periphery;

at least three springs resiliently supporting said stator platen adjacent its outer periphery at substantially equally spaced points;

said springs urging said stator platen toward said rotor platen;

said springs allowing said stator platen to move universally to a position conforming to the dynamic plane of said rotor platen;

power means for urging said rotor platen toward said resiliently supported stator platen;

said stator platen having a central orifice for feeding a substance through said stator platen against said rotor platen and radially outwardly between said platens in a layer;

a pipe leading to said orifice, for conducting a substance to said orifice; and a pump connected to said pipe;

a substance to be milled supplied by said pump being forced by said pump under pressure through said pipe and said orifice between said platens urging said platens apart in opposition to said resilient supporting means and said power means;

the layer of the substance in traveling between said platens being subjected to the shear forces generated between said platens by their forced proximity and relative rotation to disperse the components of the substance into one another;

said universally supported stator platen in conforming to the dynamic plane of said rotor platen maintaining uniform spacing between said platens over their opposed surfaces obviating channeling and subjecting the substance being milled to uniform shear forces.

2. In apparatus as set forth in claim 1, said power means for urging said rotor platen toward said resiliently supported stator platen being fluid power means;

a tube for feeding fluid under pressure to said fluid power means;

a first guage on said tube for indicating the pressure supplied to said fluid power means to urge said rotor platen toward said stator platen, a second guage on said pipe for indicating the pressure of the substance supplied by said pump between said platens;

said gauges enabling the user to coordinate the pressure on said fluid power means and the supply pressure on the substance being milled relative to one another and imposed on said resilient supporting springs to control the spacing between the platens to regulate the shear forces developed between said platens on the substance;

said gauges enabling an operator to quickly adjust the apparatus to known conditions for milling various substances and advising the force conditions on the substance being milled during the milling operation.

* * * * *